US007446791B2

(12) United States Patent
Park

(10) Patent No.: US 7,446,791 B2
(45) Date of Patent: Nov. 4, 2008

(54) THERMAL IMAGE FORMING APPARATUS INCLUDING COOLING FAN

(75) Inventor: Ju-hyun Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 115 days.

(21) Appl. No.: 11/179,477

(22) Filed: Jul. 13, 2005

(65) Prior Publication Data

US 2006/0033803 A1 Feb. 16, 2006

(30) Foreign Application Priority Data

Aug. 16, 2004 (KR) ..... 10-2004-0064223

(51) Int. Cl.
*B41J 2/375* (2006.01)

(52) U.S. Cl. ..... 347/223

(58) Field of Classification Search ..... 347/223, 347/222, 171, 197, 220, 104
See application file for complete search history.

(56) References Cited

U.S. PATENT DOCUMENTS

| | | | | |
|---|---|---|---|---|
| 4,704,620 | A | 11/1987 | Ichihashi et al. | |
| 5,374,944 | A * | 12/1994 | Janosky et al. | 347/223 |
| 6,296,405 | B1 | 10/2001 | Brewington et al. | |
| 2001/0021331 | A1 | 9/2001 | Brewington et al. | |
| 2001/0022610 | A1 | 9/2001 | Ozawa | |
| 2002/0001027 | A1 * | 1/2002 | Sugioka et al. | 347/104 |
| 2005/0259141 | A1 * | 11/2005 | Kim et al. | 347/197 |

FOREIGN PATENT DOCUMENTS

| | | |
|---|---|---|
| JP | 61-098565 | 5/1986 |
| JP | 62-119080 | 5/1987 |
| JP | 01-99867 | 4/1989 |
| JP | 3-234632 | 10/1991 |
| JP | 05-338326 | 12/1993 |
| JP | 2001-260479 | 9/2001 |
| JP | 2001-310503 | 11/2001 |
| JP | 2003-341115 | 12/2003 |
| KR | 1991-0006032 | 4/1991 |
| KR | 1999-0029972 | 7/1999 |
| KR | 1020020082944 A | 11/2002 |

* cited by examiner

*Primary Examiner*—K. Feggins
(74) *Attorney, Agent, or Firm*—Roylance, Abrams, Berdo & Goodman, LLP

(57) ABSTRACT

A thermal image forming apparatus includes a thermal printing head moves between a first position that faces a first surface of a printing medium and a second position that faces a second surface of a printing medium. A heat sink is combined with the thermal printing head. A cooling fan is installed on the heat sink, and moves with the thermal printing head to continuously cool the thermal printing head.

6 Claims, 13 Drawing Sheets

THERMAL IMAGE FORMING APPARATUS INCLUDING COOLING FAN

CROSS-REFERENCE TO RELATED PATENT APPLICATIONS

This application claims the benefit under 35 U.S.C. § 119 (a) of Korean Patent Application No. 10-2004-0064223, filed on Aug. 16, 2004, in the Korean Intellectual Property Office, the entire disclosure of which is incorporated herein by reference.

BACKGROUND OF THE INVENTION

1. Field of the Invention

The present invention relates to an image forming apparatus. More particularly, the present invention relates to a cooling fan for a thermal printing head used in a thermal printer.

2. Description of the Related Art

Thermal printers are generally one of two types of printer. The first type has an ink ribbon made of a film substrate that contacts printing media with a predetermined pressure. Ink coated on the ink ribbon is heated to transfer the ink onto the printing media. The other type of printer uses a thermal sensitive printing media. Ink layers on the media are heated by induction to reveal the ink, which is made of predetermined colors.

A thermal printing head (TPH) is used to apply heat to the ink ribbon or the thermal sensitive printing media. A TPH includes a plurality of heating elements that can be separately controlled and are disposed at predetermined intervals. The quality of an image formed by a thermal image forming apparatus depends on the temperature of the TPH. For example, after images are printed on a line, the TPH has to be quickly cooled so that print images can be printed on the next line. Also, since the temperature of the central portion of the TPH is generally higher than the temperature of the edge portions of the TPH, the TPH has to be cooled to make the temperature uniform over the entire TPH. Otherwise, image quality deteriorates due to residual heat of the TPH.

Japanese Laid-Open Patent Application No. JP2003-341115, the entire disclosure of which is hereby incorporated by reference, discloses a structure that circulates air in an image forming apparatus with a fan to cool a TPH. However, circulating air within an image forming apparatus is not as efficient as directly supplying air to cool the TPH.

Japanese Laid-Open Patent Application No. JP2001-260479, the entire disclosure of which is hereby incorporated by reference, discloses a fan installed above a TPH to directly supply air to cool the TPH. Some thermal printers, however, rotate the TPH between two positions to print on first and second surfaces of a printing medium. The disclosed structure is not suitable for use with such a thermal printer.

Accordingly, there is a need for an improved apparatus for cooling a TPH, and an image forming apparatus employing the same.

SUMMARY OF THE INVENTION

An aspect of the present invention is to solve at least the above problems and/or disadvantages and to provide at least the advantages described below. Accordingly, an aspect of the present invention is to provide a thermal image forming apparatus which can quickly and uniformly cool a thermal printing head (TPH).

According to an aspect of the present invention, a thermal image forming apparatus comprises a thermal printing head that is moved between first and second positions to face first and second surfaces of paper, respectively, a heat sink combined with the thermal printing head, and a cooling fan installed in the heat sink.

The cooling fan may be installed in the center portion of the heat sink. The heat sink may have a plurality of cooling fins extending in a lengthwise direction of the heat sink.

The thermal image forming apparatus may further comprise a platen facing the TPH and supporting the paper, wherein the TPH is rotated on the platen to be moved to the first and second positions.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
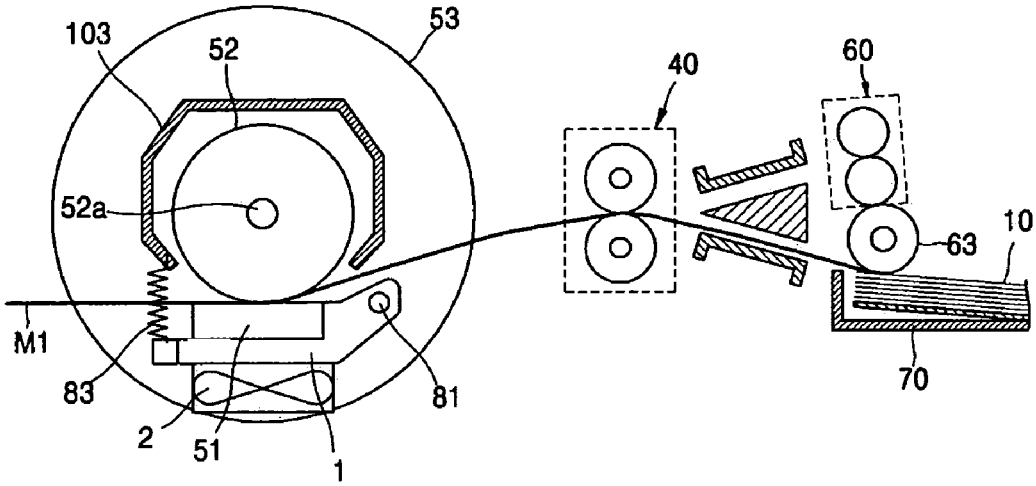
FIGS. 1 and 2 are cross-sectional views of an image forming apparatus according to an embodiment of the present invention.
Figure 2:
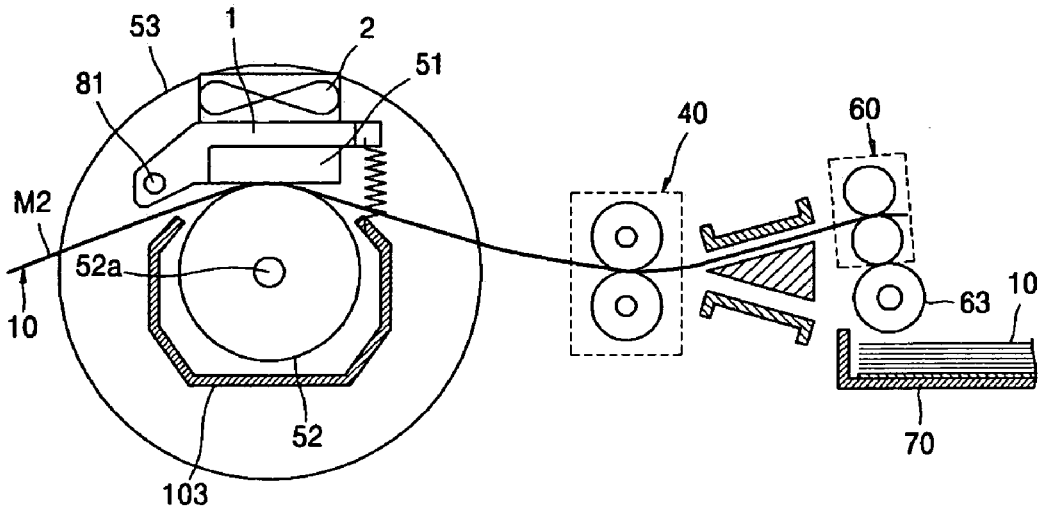

FIGS. 1 and 2 are cross-sectional views illustrating an image forming apparatus according to an embodiment of the present invention. A thermal printing head (TPH) 51 is moved to a first position to face a first surface M1 of paper 10, as shown in FIG. 1, and to a second position to face a second surface M2 of the paper 10, as shown in FIG. 2. The TPH 51 is rotated on a pivot 52*a* of a platen 52 to move to the first or second position.

A supporting bracket 53 is installed to rotate on the pivot 52*a* of the platen 52. A cover 103 covering the platen 52 is connected with the supporting bracket 53. A heat sink 1 is connected with the TPH 51. The TPH 51 is connected with the supporting bracket 53 to pivot on a hinge shaft 81. In the present embodiment, the hinge shaft 81 is installed in the heat sink 1. The heat sink 1 acts as both a heat transmission element and a supporting element to connect the TPH 51 with the supporting bracket 53. One end of a tensile spring 83 is combined with the TPH 51, and another end of the tensile spring 83 is combined with the cover 103 to elastically bias the TPH 51 into contact with the platen 52. A transfer portion 40 transfers the paper 10 at a predetermined printing speed.

Figure 6:
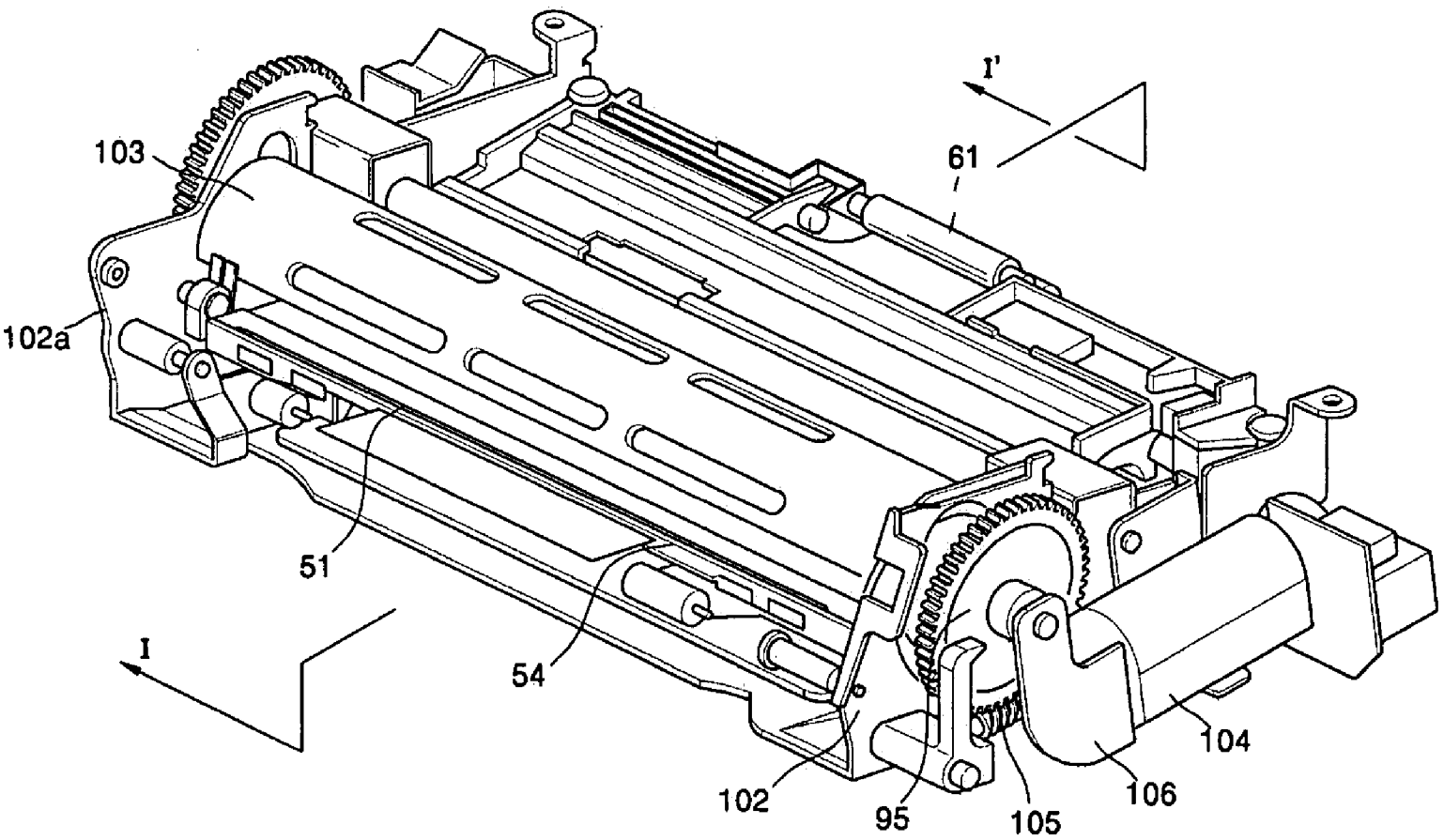
FIG. 6 is a perspective view schematically illustrating the image forming apparatus disclosed in Korean Patent Application No. 2004-42504.

A shifting unit to rotate the TPH 51 on the pivot 52*a* of the platen 52 and move it between the first position and second position is disclosed in Korean Patent Application No. 2003-101583, filed on Dec. 31, 2003, and Korean Patent Application No. 2004-42504, filed on Jun. 10, 2004. Both of these applications are assigned to the assignee of this application, and are incorporated by reference in their entirety. These applications both disclose examples of a shifting unit for moving the TPH into contact with or separating the TPH 51 from the platen 52. FIG. 6 is a perspective view schematically illustrating the image forming apparatus disclosed in Korean Patent Application No. 2004-42504, FIG. 7 is a cross-sectional view taken along the line I-I' of FIG. 6, and FIG. 8 is an exploded perspective view illustrating the rotation structure of a thermal printing head (TPH) of FIG. 6 in detail.

Figure 7:
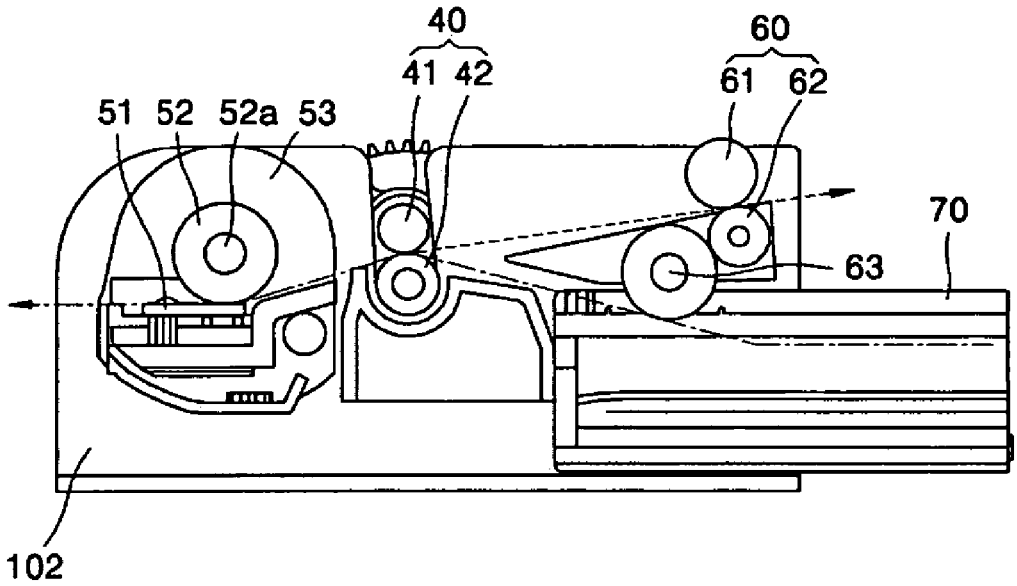
FIG. 7 is a cross-sectional view taken along line I-I' of FIG. 6.
Figure 8:
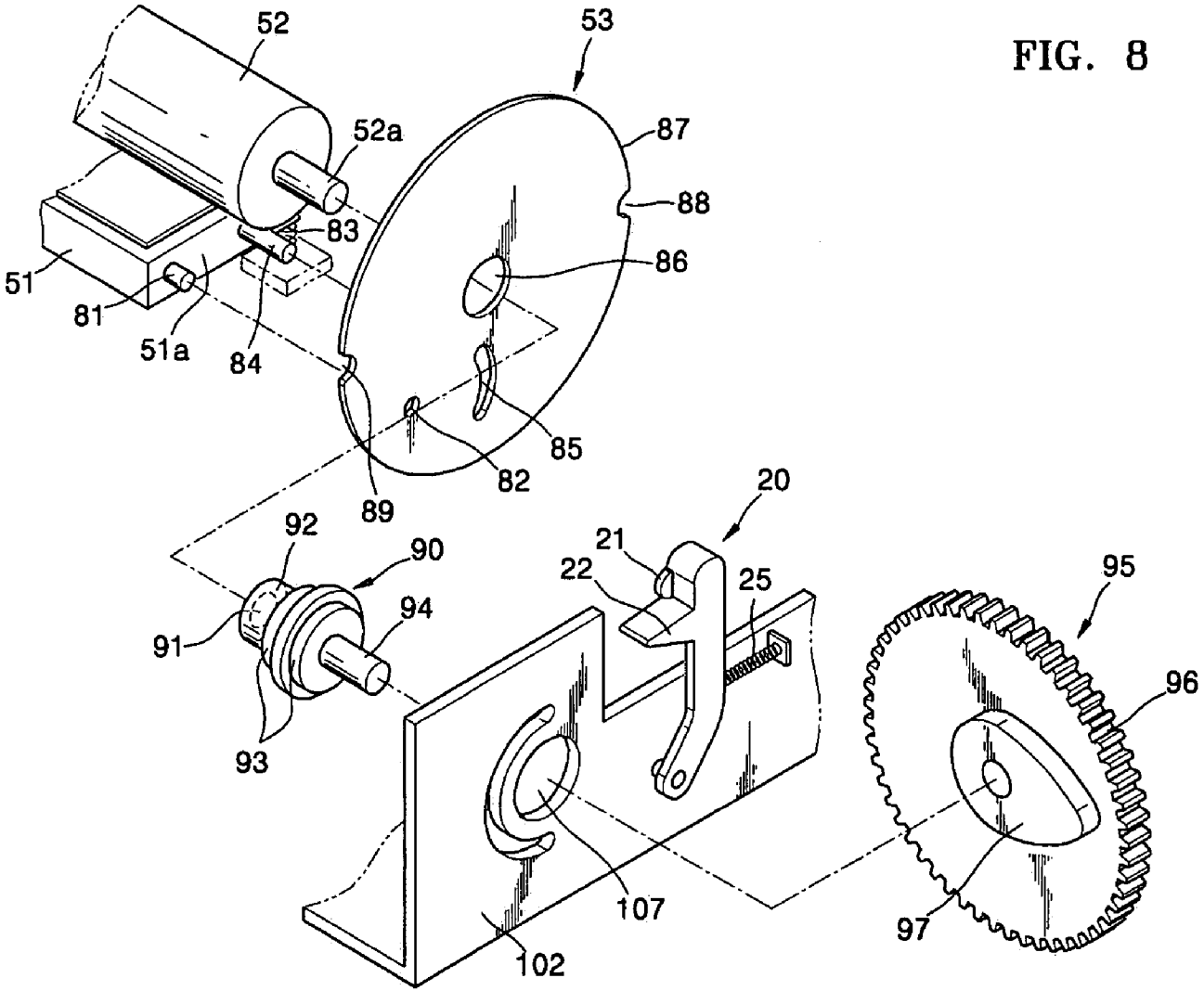
FIG. 8 is an exploded perspective view illustrating in detail a rotation structure of a thermal printing head (TPH)

Referring to FIGS. 6 through 8, the hinge shaft 81 that is provided on a side portion 51*a* of the TPH 51 is inserted in a hinge hole 82 provided in the supporting bracket 53, and the TPH 51 is connected with the supporting bracket 53 to pivot on the hinge hole 82. The TPH 51 is elastically biased toward the platen 52 by the tensile spring 83 to contact the platen 52. One end of a shaft 84 is combined with the TPH 51 and the other end of the shaft 84 is inserted in a through hole 85 provided in the supporting bracket 53. To allow the TPH 51 to move into contact with and separate from the platen 52, the through hole 85 may be formed like an elongated hole. Since the TPH 51 in the image forming apparatus according to an embodiment of the present invention pivots on the hinge hole 82 to contact or separate from the platen 52, the through hole 85 may be a circular arc around the hinge hole 82. The platen 52 in the image forming apparatus according to an embodiment of the present invention is not connected to a driving motor. The platen 52 contacts the paper to be driven in accordance with paper transferred by the transfer portion 40. Alternatively, the platen 52 may be rotated by a driving motor.

A bushing 90 includes an inner circumferential portion 91 and first, second, and third outer circumferential portions 92, 93, and 94 which are concentric. The pivot 52*a* of the platen 52 is inserted in the inner circumferential portion 91. The first outer circumferential portion 92 is inserted in a supporting hole 86 provided in the supporting bracket 53 so that it can rotate. A rotation cam 95 is combined with the third outer circumferential portion 94 so that it can rotate. The rotation cam 95 includes a gear portion 96 and a cam portion 97 contacting the shaft 84. A motor 104 of FIG. 6 includes a worm gear 105 engaged with the gear portion 96. A bracket 106, with which the motor 104 is combined, is combined with a sidewall 102. The second outer circumferential portion 93 of the bushing 90 is inserted in a hole 107 provided in the sidewall 102, and an end portion of the third outer circumferential portion 94 is supported by the bracket 106. The bracket 106 supports the rotation cam 95 so that it does not separate from the third outer circumferential portion 94. The platen 52, the supporting bracket 53, and the rotation cam 95 have the same axis of rotation. The supporting bracket 53 has a circular circumference 87, and first and second combination holes 88 and 89 placed at 180° from each other are provided on the circumference 87. A locking element 20 is pivotably connected to the sidewall 102. An elastic element 25 pushes the locking element 20 into the first and second combination holes 88 and 89. The locking element 20 is separated from the first and second combination holes 88 and 89 by the rotation cam 95 and is pushed into the first and second combination holes 88 and 89 by the elasticity of the elastic element 25. The locking element 20 includes a protrusion 21 that fits into the first and second combination holes 88 and 89 and an interference portion 22 that interferes with the cam portion 97 of the rotation cam 95.

As shown in FIG. 6, the side panel 102*a* may include a structure for allowing the TPH 51 and the platen 52 to rotate. Alternatively, the TPH 51 and the platen 52 may be pivotably mounted directly on the side panel 102*a*.

While a preferred shifting unit has been described in detail, it should be understood that the scope of the image forming apparatus according to an embodiment of the present invention is not restricted to the particular disclosed shifting unit. Similarly, the present invention is not limited to the particular structure of the unit disclosed above for moving the TPH 51 into contact with the platen 52 and separating the TPH 51 from the platen 52. Rather, the image forming apparatus according to an embodiment of the present invention is applicable to any type of printer in which the TPH 51 is moved between first and second positions where the TPH 51 faces first and second surfaces of the paper, respectively, and the scope of the present invention is not restricted to any particular method of moving the TPH 51 between the first and second positions.

Figure 3A:
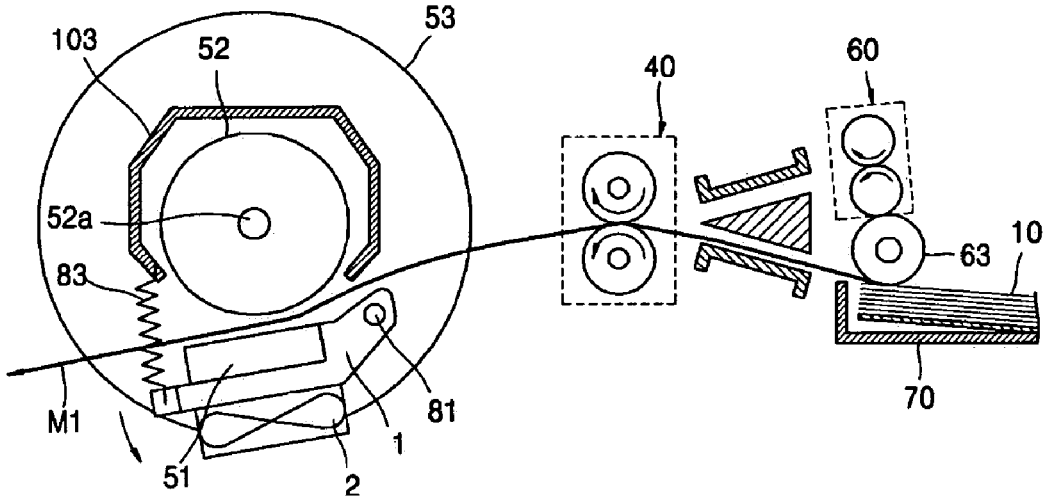
FIGS. 3A through 3F are diagrams illustrating an image forming process of the image forming apparatus according to an embodiment of the present invention.
Figure 3B:
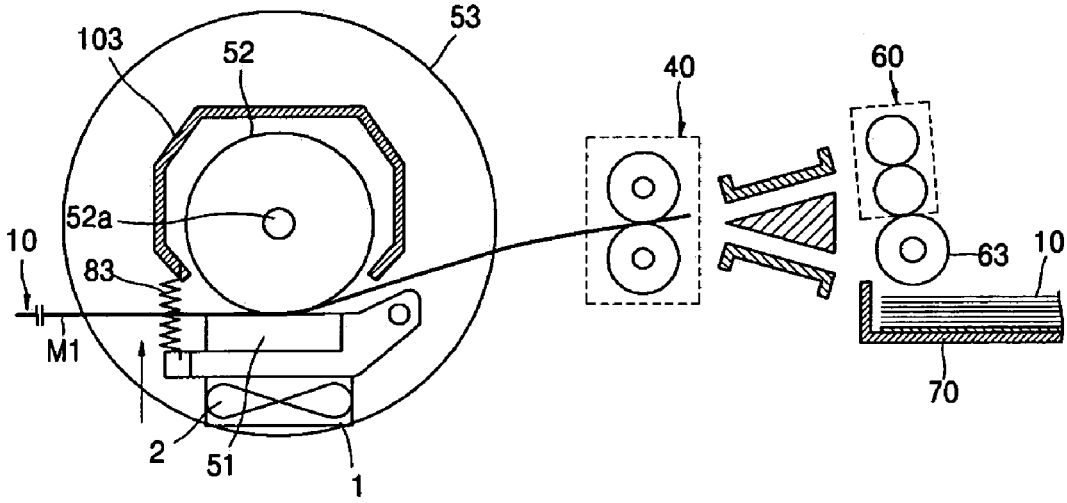
Figure 9A:
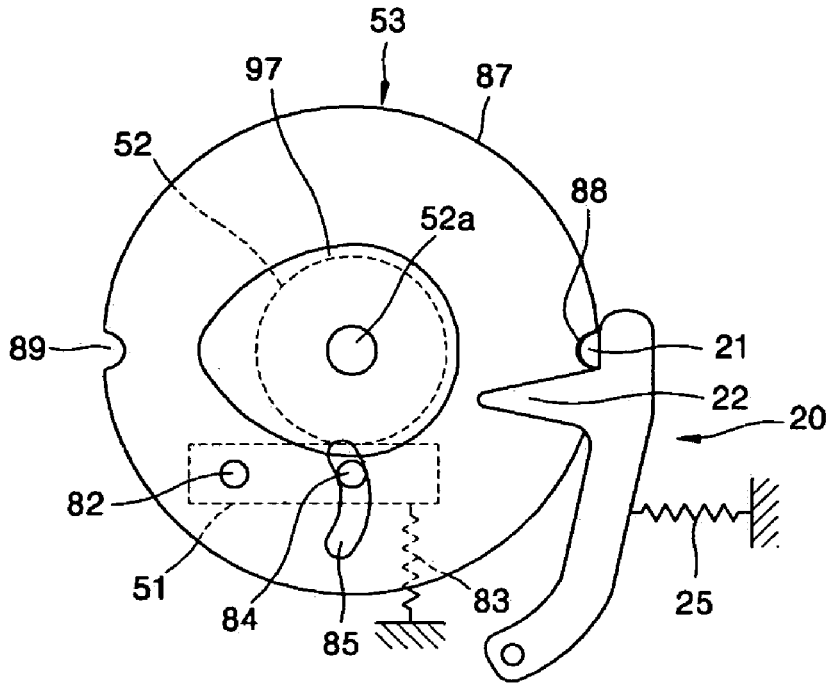
FIGS. 9A through 9I are diagrams illustrating the rotating operation of the TPH.
Figure 9B:
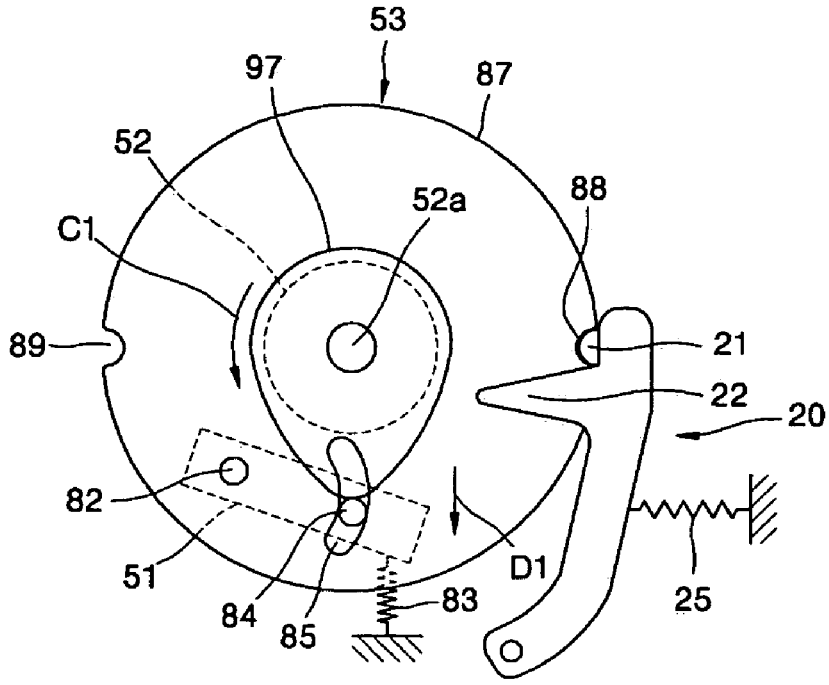

An image forming process performed by the image forming apparatus according to an embodiment of the present invention will now be described. Initially, the TPH 51 elastically contacts the platen 52 as shown in FIG. 9A. Since the protrusion 21 of the locking element 20 is hitched into the first combination hole 88, the TPH 51 is locked in the first position as shown in FIG. 1. The paper 10 discharged from a paper feeding cassette 70 by a pickup roller 63 is transferred to the transfer portion 40 through a first path. Before the paper 10 is transferred to a second path or before the paper 10 is picked up by the pickup roller 63, the TPH 51 may be moved away from the platen 52. Referring to FIG. 9B, the rotation cam 95 is rotated in direction C1, and the cam portion 97 pushes the shaft 84. Since the protrusion 21 of the locking element 20 is located in the first combination hole 88, the supporting bracket 53 does not rotate. The shaft 84 is pushed along the through hole 85 in the direction D1, and the TPH 51 pivots on the hinge hole 82 to separate from the platen 52 as shown in FIG. 3A. The paper 10 that has been picked up from the paper feeding cassette 70 by the pickup roller 63 is transferred in a first direction by the transfer portion 40. Then, the TPH 51 is separated from the platen 52, and the paper 10 is transferred between the TPH 51 and the platen 52. Referring to FIG. 3B, when the paper 10 reaches a printing start position, the transfer portion 40 stops transferring the paper 10.

Figure 9C:
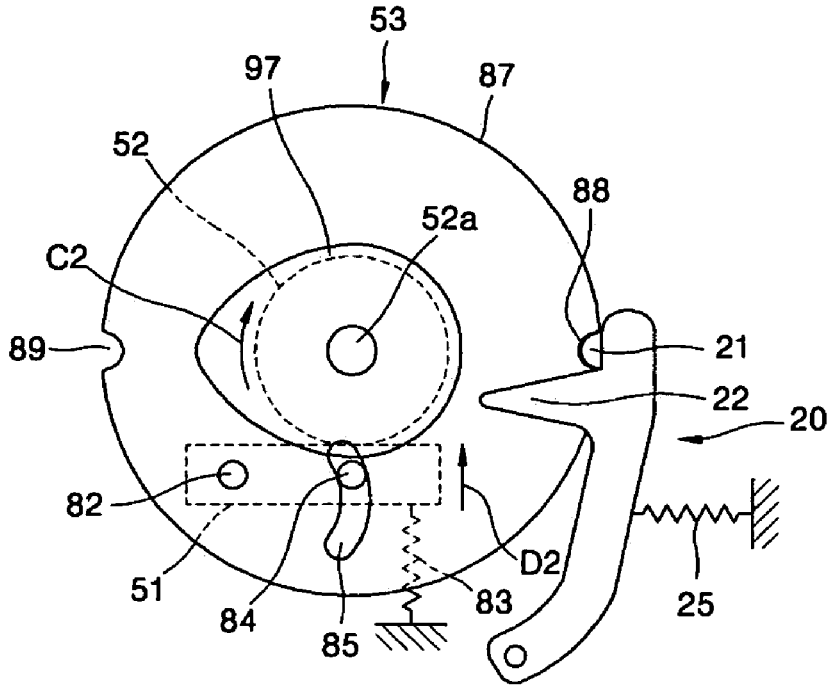

Referring to FIG. 9C, the rotation cam 95 is rotated in the direction C2. Since the protrusion 21 of the locking element 20 is located in the first combination hole 88, the supporting bracket 53 does not rotate. The TPH 51 pivots on the hinge hole 82 in the direction D2 due to the elasticity of the elastic element 83 to approach the platen 52. The TPH 51 contacts the first surface M1 of the paper 10 due to the elasticity of the elastic element 83.

Figure 3C:
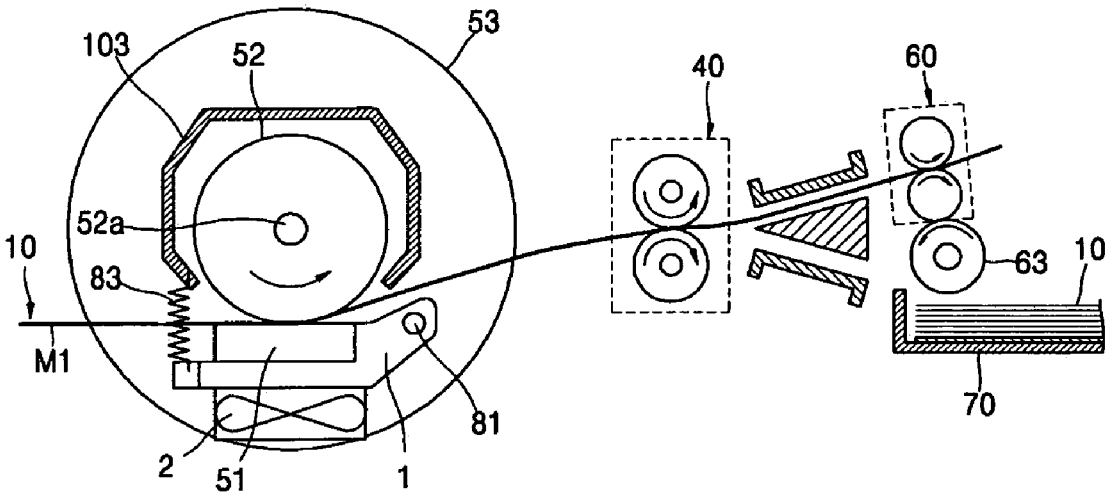
Figure 3D:
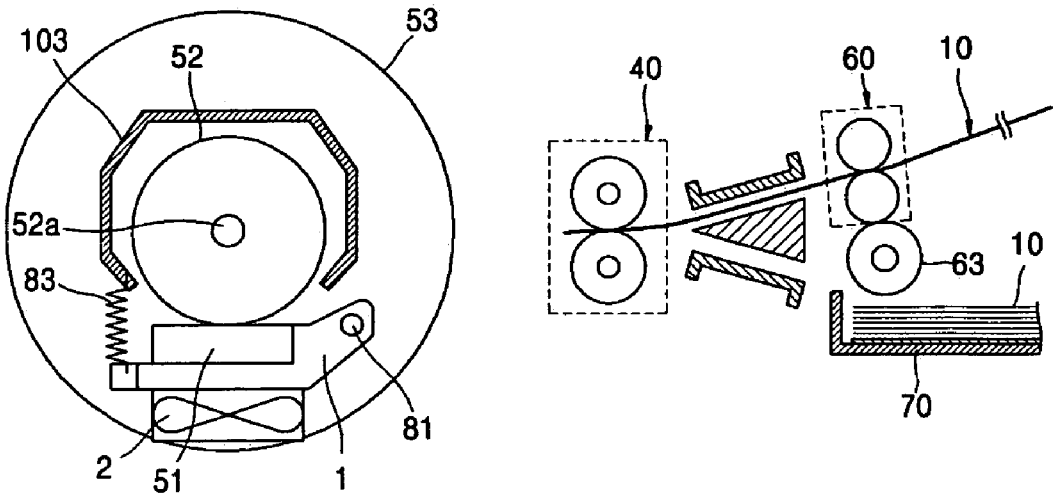

Referring to FIG. 3C, the transfer portion 40 transfers the paper 10 in the second direction at a predetermined printing speed. The TPH 51 applies heat on the first surface M1 of the paper 10 to print an image. The paper 10 is temporarily discharged through an outlet 60. When the printing on the first surface M1 of the paper 10 is finished, as shown in FIG. 3D, the transfer portion 40 stops transferring the paper 80.

Figure 9D:
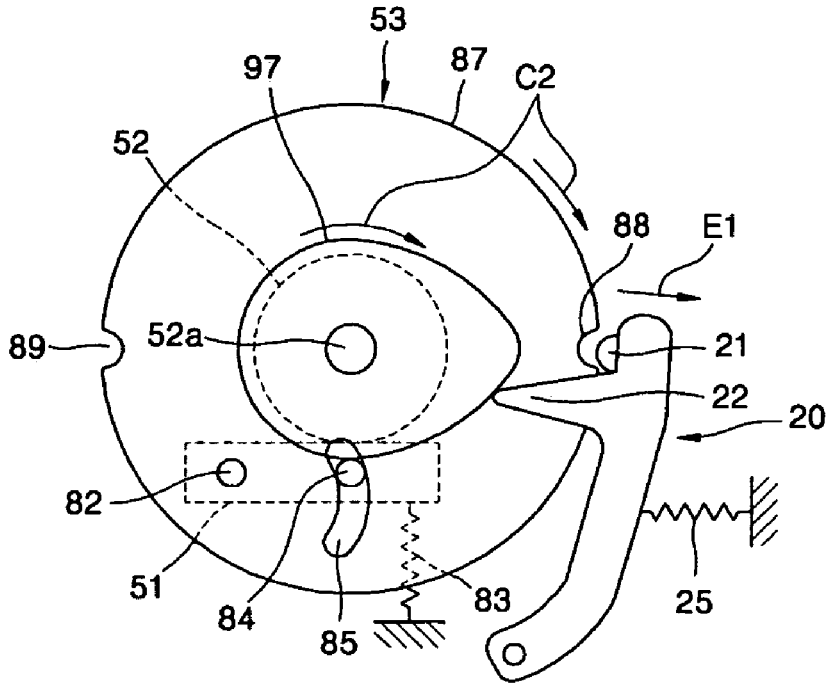
Figure 9E:
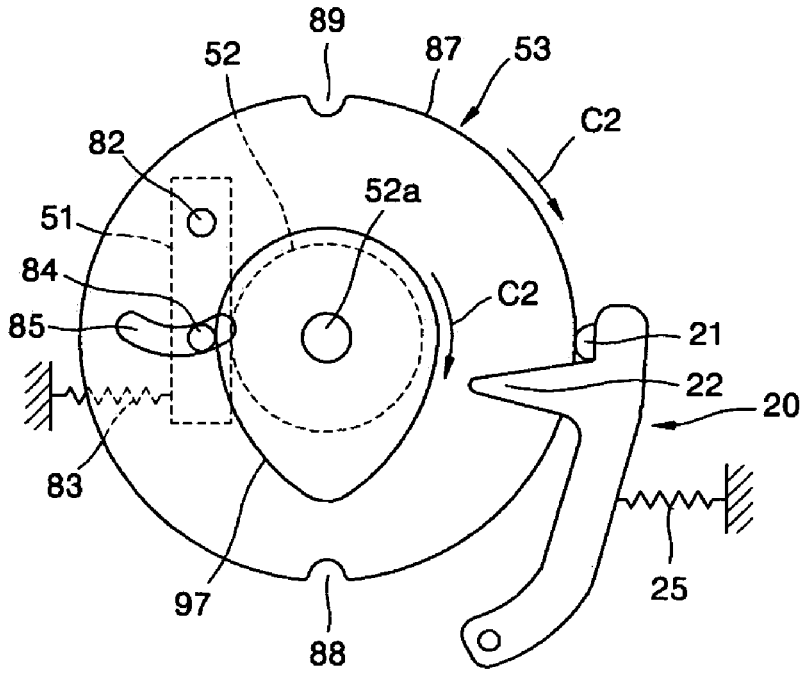
Figure 9F:
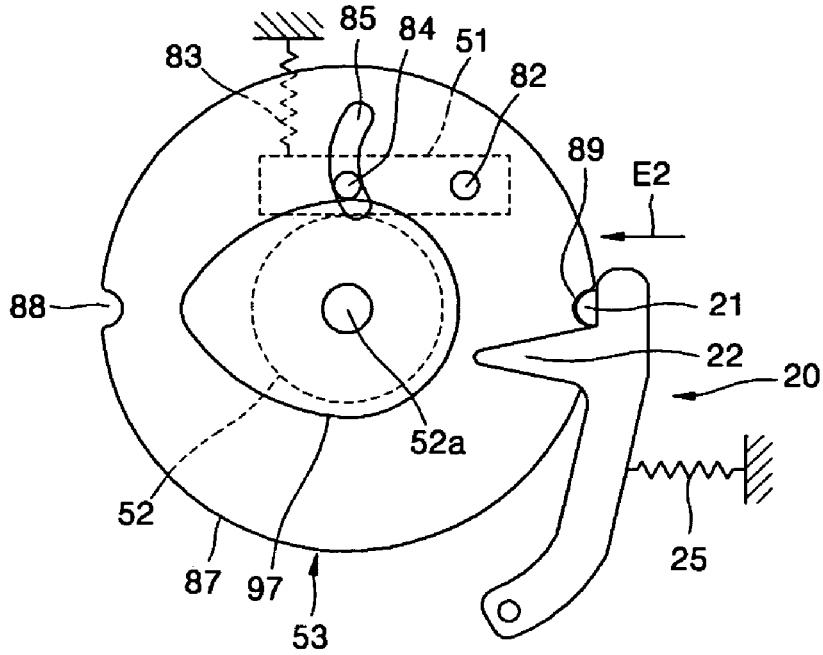

The TPH 51 faces the second surface M2 of the paper 10. Referring to FIG. 9D, when the rotation cam 95 is rotated in direction C2, the cam portion 97 pushes the interference portion 22 to rotate the locking element 20 in direction E1. The protrusion 21 is separated from the first combination hole 88, and the supporting bracket 53 can rotate freely. Accordingly, when the cam portion 97 is continuously rotated in the direction C2 to push the shaft 84, the TPH 51 does not move in the direction D1. Instead, the supporting bracket 53 rotates in the direction C2 as shown in FIG. 9E. While the supporting bracket 53 rotates in the direction C2, since the cam portion 97 pushes the shaft 84, the TPH 51 actually separates a small amount from the platen 52. When the cam portion 97 and the interference portion 22 no longer interfere with one another, the locking element 20 continuously contacts the circumference 87 of the supporting bracket 53 due to the elasticity of the elastic element 25. When the supporting bracket 53 is rotated by 180° as shown in FIG. 9F, the locking element 20 is rotated in direction E2 due to the elasticity of the elastic element 25. The protrusion 21 moves into the second combination hole 89, and the supporting bracket 53 is locked and does not rotate. The TPH 51 reaches the second position in which it faces a second surface of the paper 10 as shown in FIG. 2.

Figure 3E:
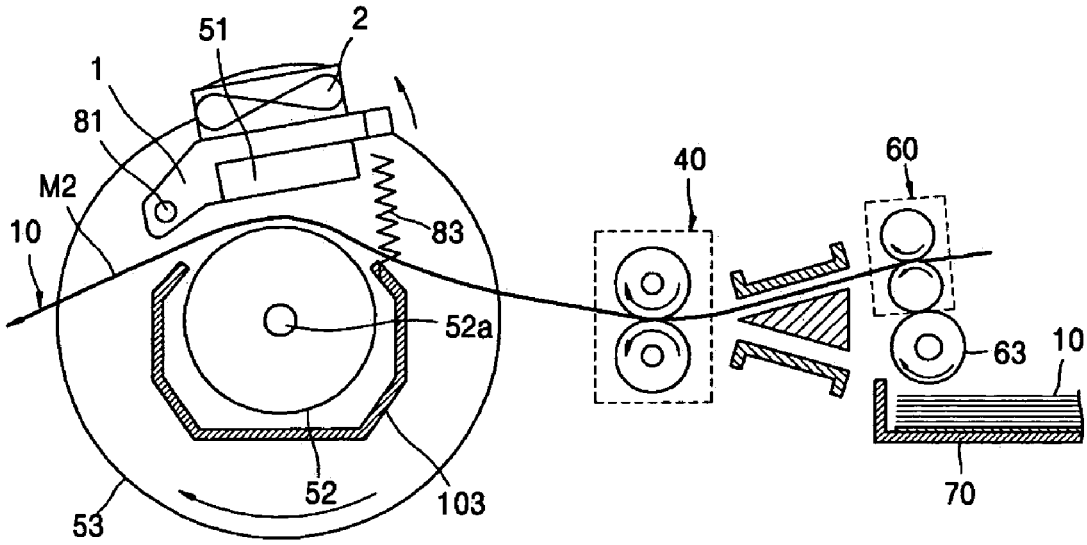
Figure 9G:
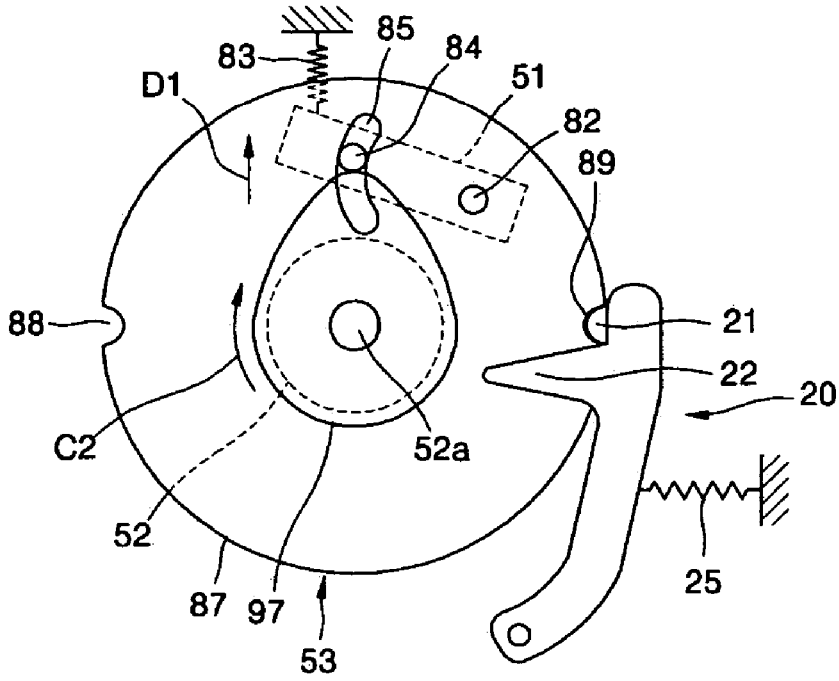

When the rotation cam 95 is continuously rotated in the direction C2, since the protrusion 21 is located in the second combination hole 89, the supporting bracket 53 does not rotate. Instead, as shown in FIG. 9G, the shaft 84 is pushed along the through hole 85 and the TPH 51 is separated from the platen 52. Then, the transfer portion 40 transfers the paper 10 in the first direction to locate the paper 10 in the printing start position as shown in FIG. 3E.

Figure 3F:
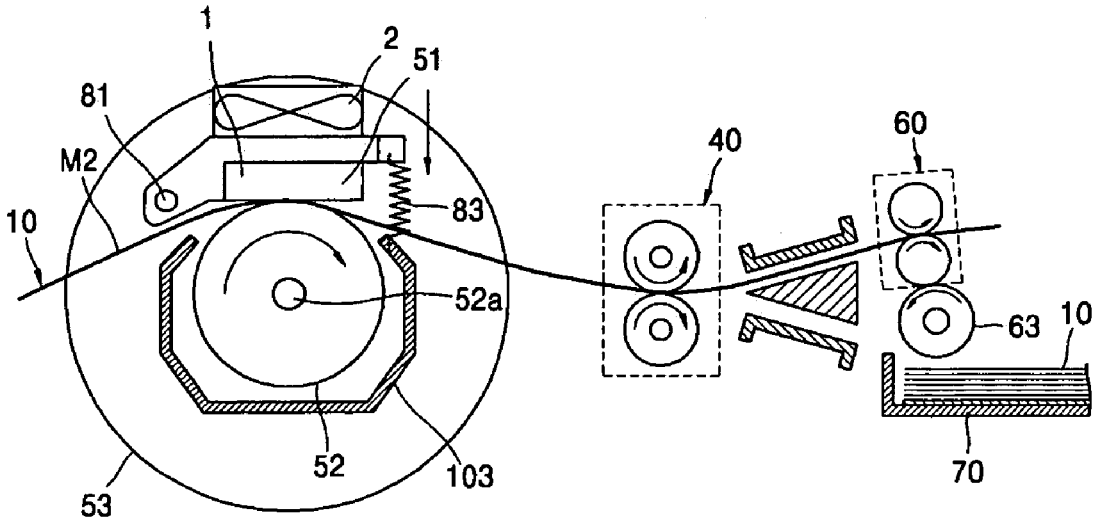
Figure 9H:
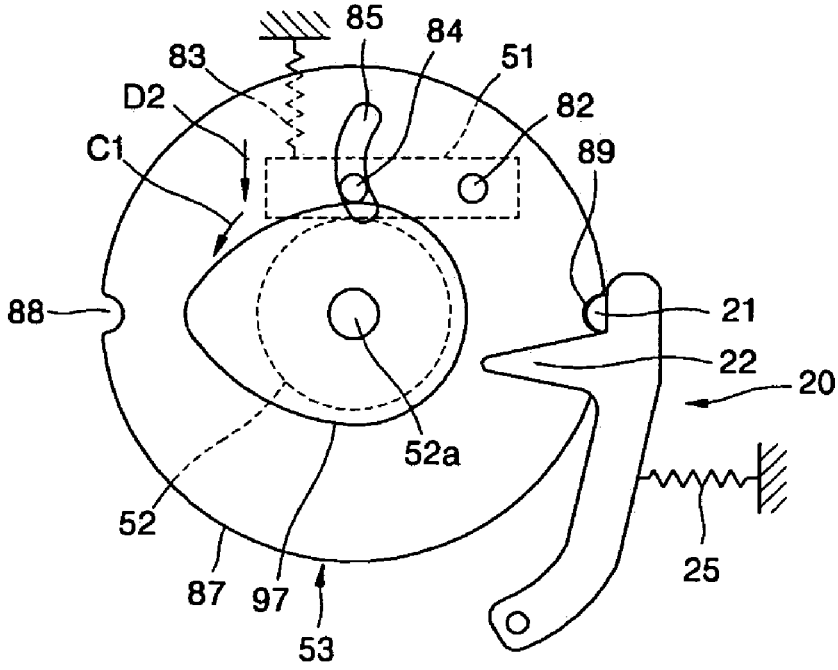

When the rotation cam 95 is rotated in the direction C1, since the protrusion 21 is located in the second combination hole 89, the supporting bracket 53 is not rotated. Instead, as shown in FIG. 9H, the shaft 84 is withdrawn along the through hole 85. As shown in FIG. 3F, the TPH 51 contacts the second surface M2 of the paper 10 due to the elasticity of the elastic element 83. The transfer unit 40 transfers the paper 10 in the second direction at a predetermined printing speed. The TPH 51 applies heat to the second surface M2 of the paper 10 to print an image. When printing is finished, the paper 10 is discharged by the outlet 60.

Figure 9I:
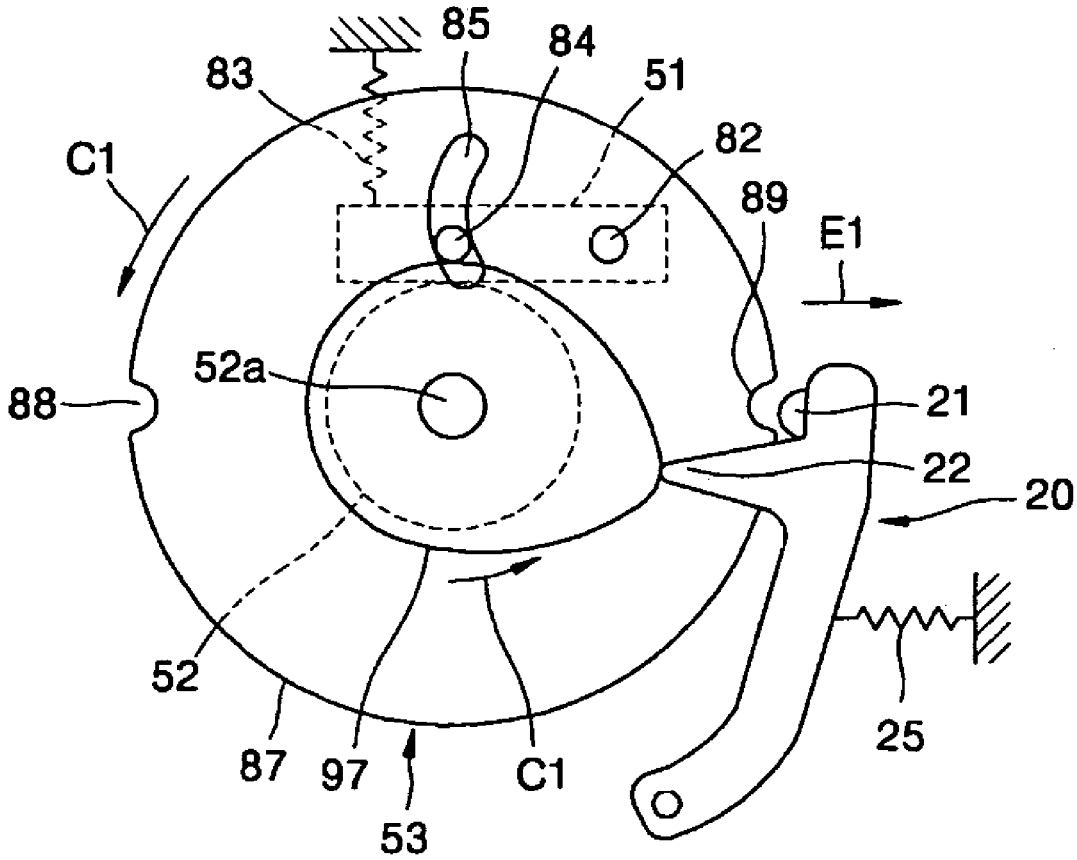

When printing is finished, as shown in FIG. 9I, the rotation cam 95 is rotated in the direction C1. The cam portion 97 pushes the interference portion 22 to rotate the locking element 20 in direction E1. Then, the protrusion 21 is separated from the second combination hole 89, and the supporting bracket 53 can be rotated freely. When the cam portion 97 pushes the shaft 84, the supporting bracket 53 rotates until the protrusion 21 moves into the first combination hole 88 due to the elasticity of the elastic element 25. The TPH 51 is returned to the first position as shown in FIG. 9A. In this state, or as shown in FIG. 9B, the TPH 51 is separated from the platen 52 and is on standby for next printing.

Figure 4:
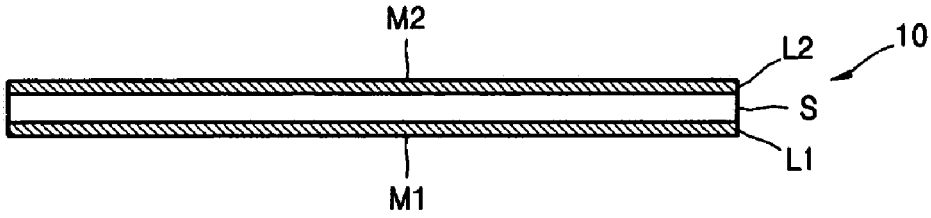
FIG. 4 is a cross-sectional view of an example of paper used in an embodiment of the present invention.

The paper 10 which is employed in the image forming apparatus according to an embodiment of the present invention may have a configuration as illustrated in FIG. 4. Ink layers L1 and L2, which react to heat and display predetermined colors, are formed on both sides of a base sheet S, namely, the first surface M1 and the second surface M2. The respective ink layers L1 and L2 may have a single layer configuration to display a single color or a multi-layer configuration to display two or more colors.

As a first example, two layers to display yellow and magenta may be provided on the ink layer L1, and a layer to display cyan may be provided on the ink layer L2. Yellow and magenta of the ink layer L1 may be selectively revealed by applying heat at an appropriate temperature and for an appropriate heating time with the TPH 51. For example, when the TPH 51 applies heat at a high temperature for a short time, yellow may be revealed. When the TPH 51 applies heat at a low temperature for a long time, magenta may be revealed. Of course, the reverse is possible. If the base sheet S is a transparent material, when yellow, magenta, and cyan of the ink layers L1 and L2 are revealed respectively, the three colors are overlapped to display a color image. Further details of the paper 10 described above are disclosed in U.S. Patent Publication No. US2003/0125206.

As a second example, if the base sheet S is an opaque material, different images can be printed on the first and second surfaces M1 and M2 respectively, so that double-sided printing is possible. Any suitable paper configuration can be used with the present invention, and the scope of the image forming method according to an embodiment of the present invention is not restricted by the particular configuration of the ink layers L1 and L2 of the first and second surfaces M1 and M2 of the paper 10.

In the TPH 51, a plurality of heating elements which can be separately controlled are disposed at predetermined intervals. In order to print an image on paper, the TPH 51 instantaneously applies heat at a high temperature on paper. The quality of a printed image depends on the temperature of the TPH 51. For example, after images are printed on one line, before images on the next line are printed, the TPH 51 has to be quickly cooled to a predetermined temperature, for example, under 60° C., or to room temperature. Also, the TPH 51 has to be cooled so that is has a uniform temperature over its entire body. Therefore, the temperature of the TPH 51 is accurately controlled to produce printed images having good quality.

Japanese Laid-Open Patent Application No. JP2001-260479 discloses a cooling configuration in which a fan is installed above the TPH 51 to directly supply air to the TPH 51 to cool the TPH 51. However, in the image forming apparatus according to an embodiment of the present invention, the TPH 51 is moved between first and second positions to face the first and second surfaces M1 and M2 of the paper 10. Accordingly, when the TPH 51 is located in the second position, air is directly supplied to the TPH 51, but when the TPH 51 is located in the first position, the platen 52 is interposed between the fan and the TPH 51, and air is not directly supplied to the TPH 51. Accordingly, the TPH 51 is not successfully cooled.

Japanese Laid-Open Patent Application No. JP2003-341115 discloses a cooling configuration in which the air in an image forming apparatus is circulated by a fan to cool a TPH. This cooling configuration has lower cooling performance than the cooling configuration in which air is directly supplied to the TPH 51.

Figure 5:
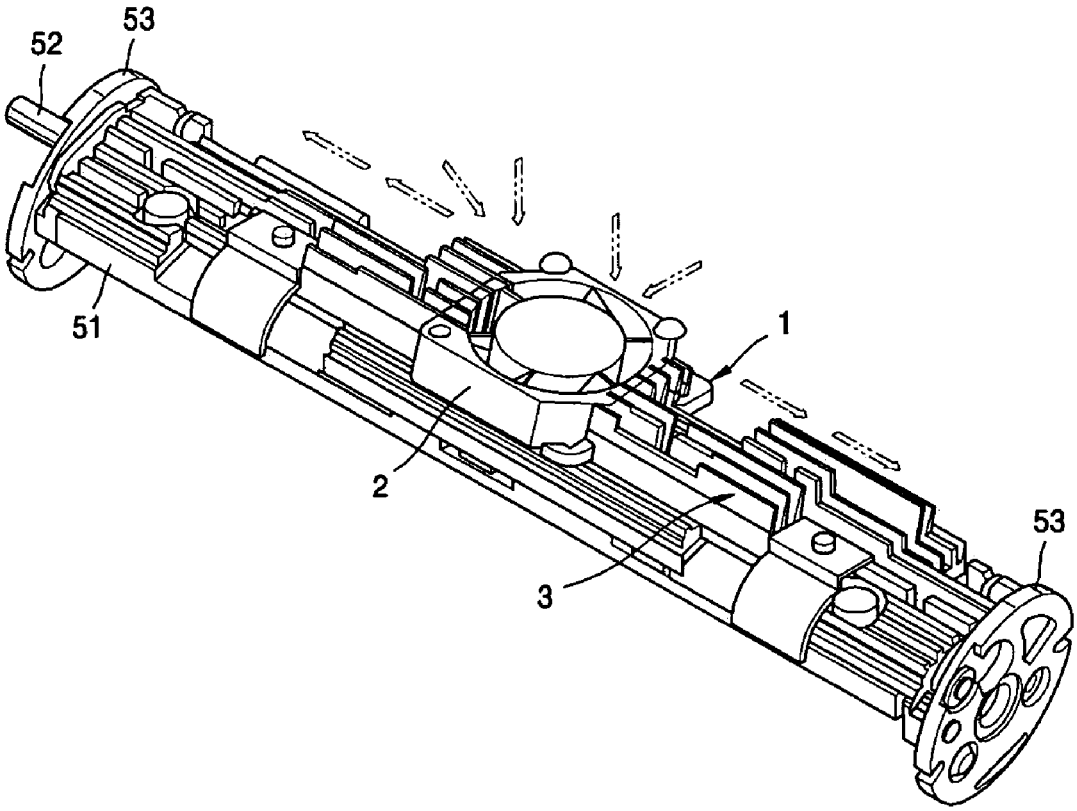
FIG. 5 is a perspective view of a heat sink and a cooling fan.

In the image forming apparatus according to an embodiment of the present invention, a cooling fan 2 is moved with the TPH 51 together, thereby improving cooling efficiency of the TPH 51. To accomplish this, the cooling fan 2 is combined with the heat sink 1 as shown in FIG. 5. The temperature of the center portion of the TPH 51 is higher than the temperature of edge portions of the TPH 51, and the cooling fan 2 may be installed in the center portion in order to uniformly cool the TPH 51. The cooling fan 2 can supply air to the heat sink 1 or can suck air from the heat sink 1. According to experimental results, supplying air to the heat sink 1 shows good cooling efficiency. In the structure described above, heat generated by the TPH 51 is transmitted to the heat sink 1. The air supplied to the center portion of the heat sink 1 by the cooling fan 2 spreads lengthwise and absorbs heat from the heat sink 1 to cool the TPH 51. Since the cooling fan 2 is moved with the TPH 51 together, regardless of whether the TPH 51 is in the first position or the second position, an approximately identical cooling efficiency can be obtained. Accordingly, when the paper of the first example is used, color images having good quality can be printed. When the paper of the second example is used, images printed on both sides of the paper may have uniform quality. Also, while the TPH 51 is moved from the first position to the second position, the cooling fan 2 is operated to continuously cool the TPH 51.

A plurality of cooling fins 3 to enlarge a cooling area are provided in the heat sink 1. The cooling fins 3 extend in a lengthwise direction of the heat sink 1. A transfer path is formed between the plurality of cooling fins 3. In the structure described above, the air sucked by the cooling fan 2 passes the center portion of the heat sink 1 along the spaces between a plurality of cooling fins, is moved lengthwise in the heat sink 1, and absorbs heat from the heat sink 1 to cool the TPH 51.

The above described thermal printer according to the present invention has the following advantages. First, a cooling fan is installed in a heat sink combined with a TPH, is moved with the TPH, and continuously cools the TPH, thereby accurately controlling the temperature of the TPH to improve image quality.

Second, a cooling fan is installed in the center portion of a heat sink thereby reducing temperature differentials between the center portion of a TPH and edge portions of the TPH.

Third, a plurality of cooling fins are provided lengthwise in a heat sink, thereby inducing the air supplied by a cooling fan to move in a lengthwise direction of the heat sink to uniformly cool a TPH.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A thermal image forming apparatus comprising:

a thermal printing head (TPH) that is moved to first and second positions to face first and second surfaces of paper, respectively;

a heat sink combined with the thermal printing head; and a cooling fan installed on the heat sink, wherein the cooling fan is installed in the center portion of the heat sink.

2. The apparatus of claim 1, wherein the heat sink has a plurality of cooling fins extending in a lengthwise direction of the heat sink.

3. A thermal image forming apparatus comprising:

a thermal printing head (TPH) that is moved to first and second positions to face first and second surfaces of paper, respectively;

a heat sink combined with the thermal printing head;

a cooling fan installed on the heat sink; and a platen facing the TPH and supporting the paper, wherein the TPH is rotated on the platen to be moved to the first and second positions.

4. A thermal image forming apparatus for forming images on a printing medium, comprising:

a thermal printing head, the thermal printing head moving between a first position facing a first surface of the printing medium and a second position facing the second surface of the printing medium;

a heat sink installed on the thermal printing head; and a cooling fan installed on the heat sink, wherein the cooling fan is installed in the center portion of the heat sink.

5. The apparatus of claim 4, wherein the heat sink has a plurality of cooling fins extending in a lengthwise direction of the heat sink.

6. A thermal image forming apparatus for forming images on a printing medium, comprising:

a thermal printing head, the thermal printing head moving between a first position facing a first surface of the printing medium and a second position facing the second surface of the printing medium;

a heat sink installed on the thermal printing head; and a cooling fan installed on the heat sink, wherein the cooling fan operates while the thermal print head moves between the first and the second positions.

* * * * *